US006554594B2

(12) United States Patent
Yamamoto et al.

(10) Patent No.: US 6,554,594 B2
(45) Date of Patent: Apr. 29, 2003

(54) SHAFT SEAL STRUCTURE FOR VACUUM PUMP

(75) Inventors: Shinya Yamamoto, Kariya (JP); Yoshinari Suzuki, Kariya (JP); Masahiro Ida, Kariya (JP); Masahiro Kawaguchi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/011,099

(22) Filed: Dec. 7, 2001

(65) Prior Publication Data

US 2002/0096838 A1 Jul. 25, 2002

(30) Foreign Application Priority Data

Jan. 24, 2001 (JP) ..... 2001-015350

(51) Int. Cl.[7] ..... F01C 19/00
(52) U.S. Cl. ..... 418/104; 418/79; 418/206.6
(58) Field of Search ..... 418/206.6, 104, 418/79

(56) References Cited

U.S. PATENT DOCUMENTS 1,795,579 A * 3/1931 Storey ..... 418/79
2,756,684 A * 7/1956 Renzo ..... 418/79
2,891,483 A * 6/1959 Murray et al. ..... 418/80
4,990,069 A * 2/1991 Guittet et al. ..... 418/104

FOREIGN PATENT DOCUMENTS

| | | | | |
|---|---|---|---|---|
| EP | 427973 A | * | 5/1991 | ..... F04C/2/08 |
| GB | 2175956 A | * | 12/1986 | ..... F04C/27/00 |
| JP | 63277877 A | * | 11/1988 | ..... F04C/2/18 |
| JP | 04314992 A | * | 11/1992 | ..... F04C/27/00 |
| JP | 6-081788 | | 3/1994 | |
| JP | 6-101674 | | 4/1994 | |

* cited by examiner

*Primary Examiner*—Thomas Denion
*Assistant Examiner*—Theresa Trieu
(74) *Attorney, Agent, or Firm*—Morgan & Finnegan, LLP

(57) ABSTRACT

A vacuum pump has a housing accommodating a rotary shaft and a gas transferring assembly driven by the rotary shaft. The housing has an exhaust passage for exhausting gas outside the housing. The gas transferring assembly creates a vacuum. A lip seal for shaft seal is disposed between a pump chamber communicating with the exhaust passage and a region in which oil exists so as to slide relative to a circumferential surface of the rotary shaft. The lip seal has a back pressure surface in a back pressure region facing the pump chamber and a pressure surface facing the region in which the oil exists. A communicating passage in the housing intercommunicates the back pressure region and the exhaust passage for applying at least substantially the pressure in the exhaust passage to the back pressure surface.

10 Claims, 8 Drawing Sheets

(a)
M
11
12
13
15
17
19
20
21
22
23
24
25
26
27
28
29
30
31
32
33
34
35
36
37
38
39
40
41
42
43
44
45
46
47
48
50
51
52
53
54
55
56
14
16
141
142
143
144
145
163
191
192
201
202
331
371
381
471
481
I
II
III
IV

SHAFT SEAL STRUCTURE FOR VACUUM PUMP

BACKGROUND OF THE INVENTION

The present invention relates to shaft seal structure for a vacuum pump that drives a gas transferring assembly due to rotation of a rotary shaft, generates vacuum action by transferring gas due to motion of the gas transferring assembly.

Japanese Unexamined Patent Publication No. 6-101674 discloses a vacuum pump that drives a gas transferring assembly due to rotation of a rotary shaft, generates vacuum action by transferring gas due to motion of the gas transferring assembly. This kind of vacuum pump has a plurality of rotary shafts that support each rotor or gas transferring assembly, and the rotary shafts are synchronously driven through a gear mechanism. The gear mechanism is lubricated by lubricant prepared in an oil bath in a gear case. The lubricant is also used for lubricating bearings which rotatably support the rotary shafts.

To prevent the lubricant in the oil bath from leaking into a pump chamber which accommodates the rotors in a housing, lip seals are disposed at the surfaces of the rotary shafts between the bearings and the housing.

An unwanted effect of the lip seal is that the large pressure difference between the two surfaces of the lip seal causes the lubricant in the gear case to leak into the pump chamber, with a consequent of deterioration of the durability of the lip seal and shortened lifetime of the lip seal.

A screw type vacuum pump disclosed in Japanese Unexamined Patent Publication No. 6-81788 is provided with an annular recess formed on a bottom end surface of a screw rotor, and a discharge port of the vacuum pump opens so as to wrap over a part of the recess as seen in an axial direction of a rotary shaft. Pressure in the discharge port is applied to a back surface of a lip seal via the recess. Thereby, the pressure difference between the two surfaces of the lip seal can be reduced.

However, in a roots pump, cocoon-shaped rotors are engaged with each other so that forming annular recesses at the rotors so as to communicate with a discharge port is difficult since the location of the discharge port is restricted within a limited space.

SUMMARY OF THE INVENTION

The present invention addresses the above-mentioned problems traceable to a pressure difference applied to surfaces of a lip seal by reducing the pressure difference. Accordingly, it is an object of the present invention to improve sealing performance and lengthen the lifetime of the lip seal by reducing pressure difference between the two surfaces of the lip seal.

According to the present invention, a vacuum pump has a housing accommodating a rotary shaft and a gas transferring assembly driven by the rotary shaft. The housing has an exhaust passage for exhausting gas outside the housing. The gas transferring assembly creates a vacuum. A lip seal for shaft seal is disposed between a pump chamber communicating with the exhaust passage and a region in which oil exists so as to slide relative to a circumferential surface of the rotary shaft. The lip seal has a back pressure surface in a back pressure region facing the pump chamber and a pressure surface facing the region in which the oil exists. A communicating passage in the housing intercommunicates the back pressure region and the exhaust passage for applying at least substantially the pressure in the exhaust passage to the back pressure surface. Thereby, at least substantially the pressure in the exhaust passage is applied to the back pressure surface of the lip seal. Accordingly, the difference between the pressures applied to the pressure surface and the back pressure surface is reduced.

Either pressure in a highest pressure region in the pump chamber communicating with the exhaust passage or the pressure in the exhaust passage is applied to the back pressure surface of the lip seal via the communicating passage. This can reduce the difference between the pressures applied to the two surfaces of the lip seal, as compared with structure without the communicating passage.

The present invention has such a feature that a region to which substantially the same pressure as the exhaust passage is applied is the highest pressure region. The pressure in the highest pressure region is applied to the back pressure surface of the lip seal via the communicating passage.

The pressure in the highest pressure region is applied to the back pressure surface of the lip seal via the communicating passage. Such structure for applying the pressure in the highest pressure region to the back pressure surface via the communicating passage can reduce the pressure difference between the pressures applied to the two surfaces of the lip seal, as compared with structure without the communicating passage.

The present invention has the following feature that the housing forming the communicating passage includes a dividing wall. The dividing wall divides the region in which the oil exists and the pump chamber communicating with the exhaust passage. The rotary shaft extends through a bore in the dividing wall from the pump chamber into the region in which the oil exists.

The communicating passage is formed in the dividing wall. The pressure in the highest pressure region is applied to the back pressure surface of the lip seal via the communicating passage.

The present invention has such a feature that the dividing wall provides a wall surface defining the pump chamber. The communicating passage is a recessed channel in the wall surface. The channel extends to the dividing wall bore.

The pressure in the highest pressure region or the pressure in the exhaust passage is applied to the back pressure surface of the lip seal via the recess and a gap between the circumferential surface of the rotary shaft and the shaft hole.

The present invention further includes a first extending portion formed on the circumferential surface of the rotary shaft so as to reduce a gap between the circumferential surface of the rotary shaft and the shaft hole. The recess reaches the shaft hole so as to pass by a part of the extending portion.

The present invention further includes a second extending portion formed on the rear end surface of the rotor so as to reduce a gap between the rear end surface of the rotor and the dividing wall. The recess reaches the shaft hole so as to pass by a part of the second extending portion.

The first and second extending portions are efficient in applying the pressure in the highest pressure region or the pressure in the exhaust passage to the back pressure surface of the lip seal.

The present invention has the following feature that the region in which the oil exists is a region accommodating a bearing for rotatably supporting the rotary shaft.

The oil lubricating the bearing also lubricates the lip seal.

The present invention further includes a feature as follows. The vacuum pump is a roots pump. The gas transferring mechanism has a plurality of generally parallel rotary shafts. Each of the rotary shaft carries a rotor with adjacent rotors. The adjacent rotors are engaged with each other. A set of the engaged rotors is accommodated in either a plurality of the pump chambers or the single pump chamber.

Such vacuum pump as a roots pump is appropriate for applying the present invention.

The present invention has such a feature that a plurality of the rotary shafts is synchronously driven through a gear mechanism. The region in which the oil exists includes a region accommodating the gear mechanism.

The oil lubricating the gear mechanism also lubricates the lip seal.

Other aspects and advantages of the invention will become apparent from the following description, taken in conjunction with the accompanying drawings, illustrating by way of example the principles of the invention.

The invention together with objects and advantages thereof, may best be understood by reference to the following description of the presently preferred embodiments together with the accompanying drawings.

DETAILED DESCRIPTION OF THE PREFERRED EMBODIMENTS

A first embodiment of the present invention will now be described with reference to FIGS. 1 through 4.

Figures 1A, 1B, 1C:
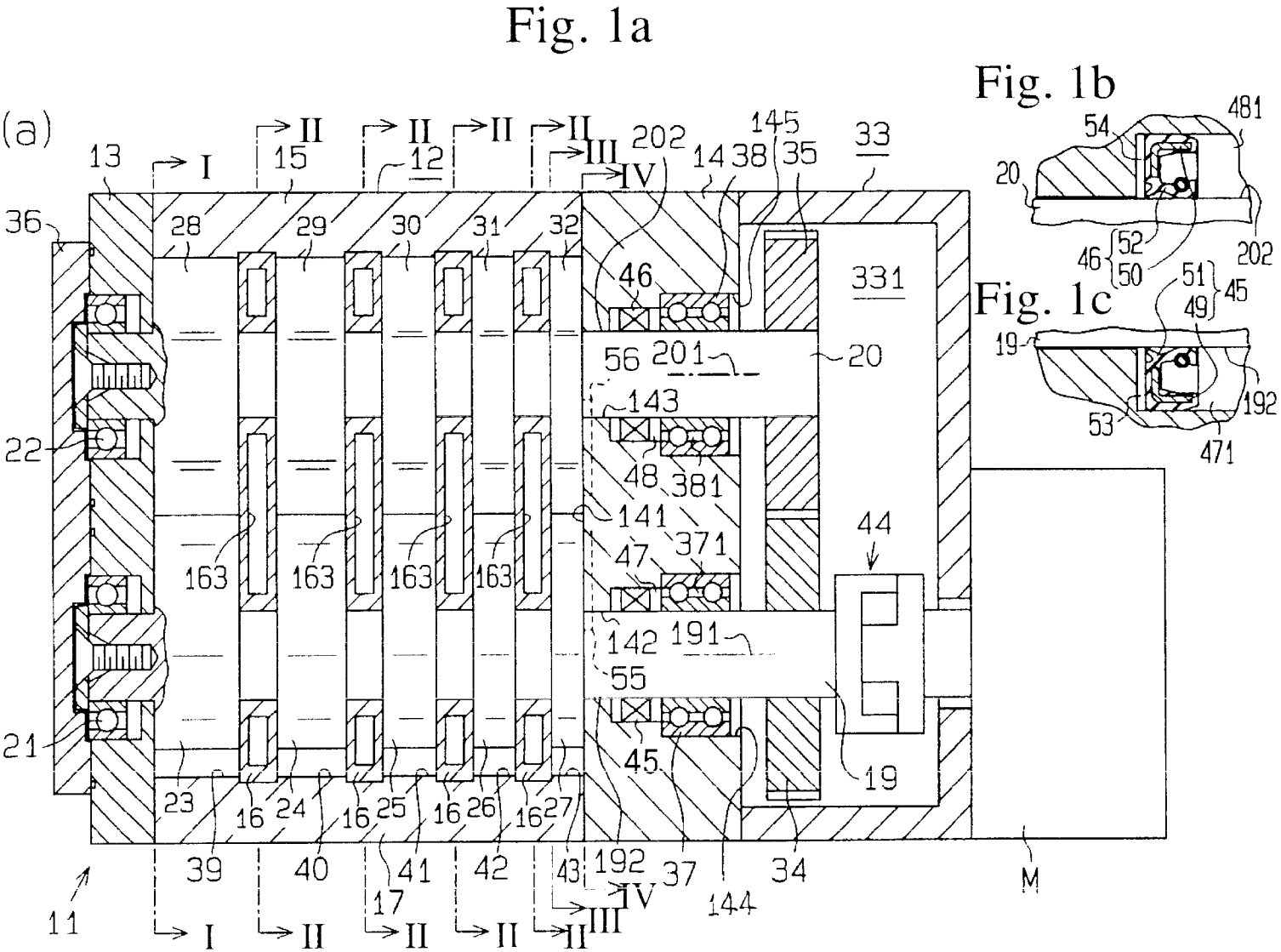
FIG. 1*a* is a longitudinal cross-sectional view of a multi-stage roots pump according to a first embodiment of the present invention.
FIG. 1*b* is a cross-sectional view on the side of a lip seal 46 according to the first embodiment of the present invention.
FIG. 1*c* is a cross-sectional view on the side of a lip seal 45 according to the first embodiment of the present invention.

As shown in FIG. 1*a*, a multi-stage roots pump 11 has a rotor housing 12, a front housing 13 and a rear housing 14. The front housing 13 is coupled to the rotor housing 12 on its front end. The end plate 36 is coupled to the front housing 13. The rear housing 14 is coupled to the rotor housing 12 on its rear end. The rotor housing 12, the front housing 13 and the rear housing 14 constitute a housing of the roots pump. The rotor housing 12 is constituted of a cylinder block 15 and a plurality of partition walls 16. As shown in FIG. 2*b*, the cylinder block 15 is constituted of a pair of block pieces 17, 18 and each of the partition walls 16 is constituted of a pair of wall pieces 161, 162. As shown in FIG. 1*a*, a space between the front housing 13 and a frontmost partition wall 16, spaces between the partition walls 16, and a space between the rear housing 14 and a rearmost partition wall 16 are defined as pump chambers 39, 40, 41, 42, 43, respectively.

A pair of rotary shafts 19, 20 are rotatably supported by the front housing 13 and the rear housing 14 via radial bearings 21, 37, 22, 38, respectively. Both the rotary shafts 19, 20 are disposed in parallel with each other. The rotary shafts 19, 20 extend through the partition walls 16.

A plurality of rotors 23, 24, 25, 26, 27 is integrally formed with the rotary shaft 19. Also, the same number of rotors 28, 29, 30, 31, 32 is integrally formed with the rotary shaft 20. The rotors 23 through 32 are congruously formed as seen in a direction of axes 191, 201 of the rotary shafts 19, 20. Thickness of the rotors 23, 24, 25, 26, 27 become thinner in this order. Also, thickness of the rotors 28, 29, 30, 31, 32 become thinner in this order. A pair of the rotors 23, 28 is accommodated in the pump chamber 39 so as to engage with each other. A pair of the rotors 24, 29 is accommodated in the pump chamber 40 so as to engage with each other. A pair of the rotors 25, 30 is accommodated in the pump chamber 41 so as to engage with each other. A pair of the rotors 26, 31 is accommodated in the pump chamber 42 so as to engage with each other. A pair of the rotors 27, 32 is accommodated in the pump chamber 43 so as to engage with each other. The inside of the pump chambers 39 through 43 are not lubricated. Therefore, each of the rotors 23 through 32 is not kept in slide contact with the cylinder block 15, the partition walls 16, the front housing 13 and the rear housing 14. Also, a pair of the rotors engaging with each other does not keep in slide contact with each other.

Figure 2A:
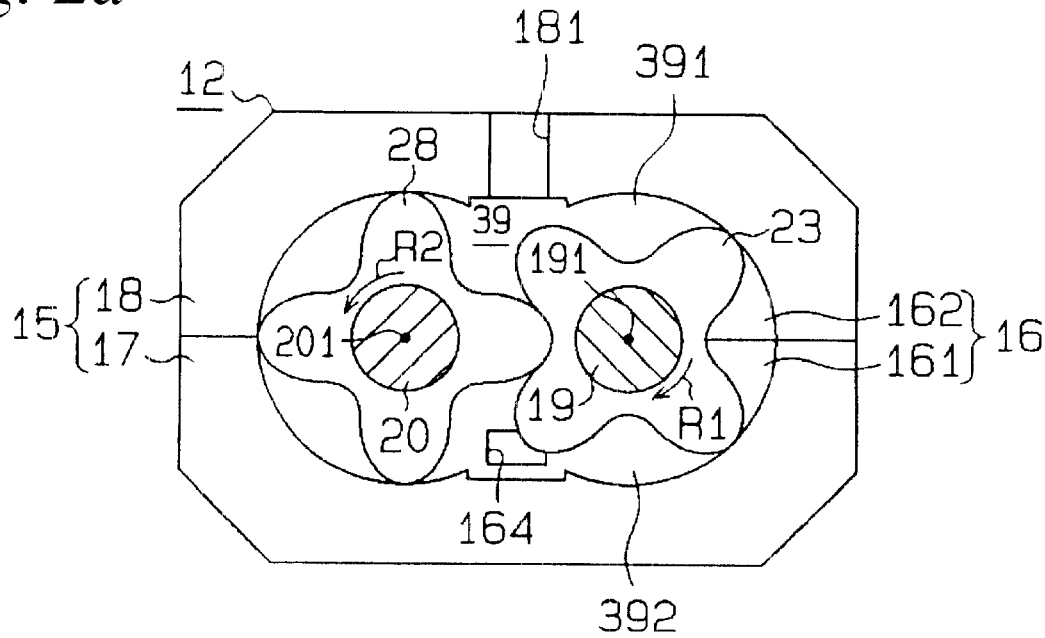
FIG. 2*a* is a cross-sectional end view, taken along the line I—I in FIG. 1.
Figure 2B:
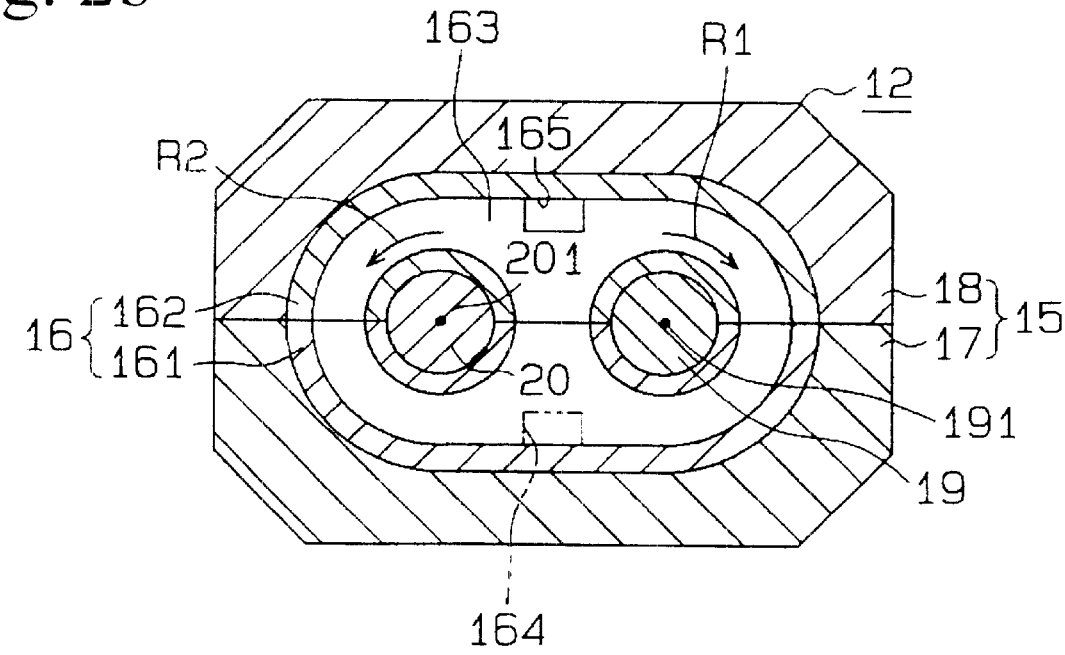
FIG. 2*b* is a cross-sectional end view, taken along the line II—II in FIG. 1.
Figure 3A:
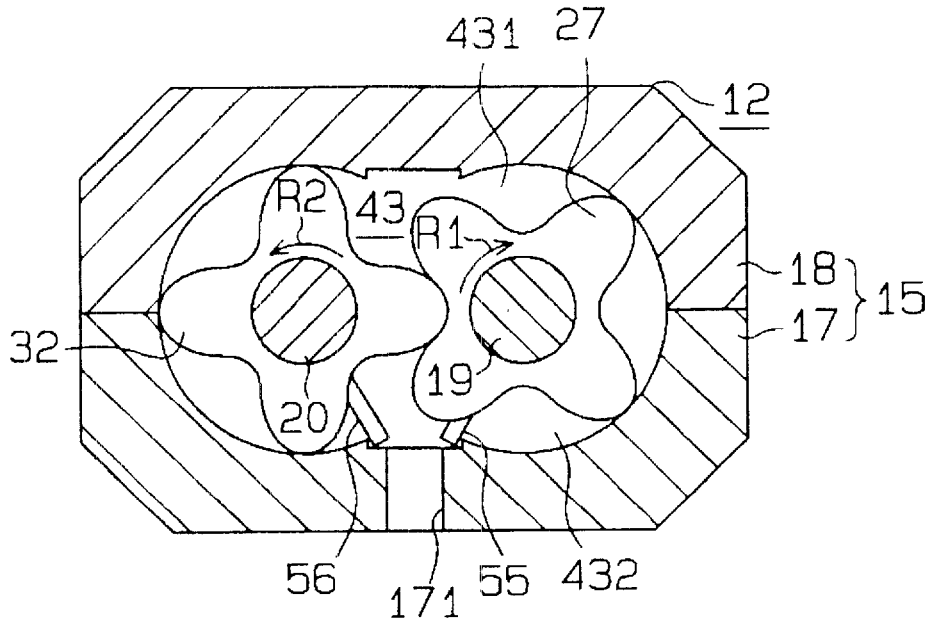
FIG. 3*a* is a cross-sectional end view, taken along the line III—III in FIG. 1.

As shown in FIG. 2*a*, the rotors 23, 28 define a suction region 391 and a high pressure region 392 in the pump chamber 39. Pressure in the high pressure region 392 is higher than pressure in the suction region 391. Likewise, the rotors 24, 29, the rotors 25, 30 and the rotors 26, 31 define a suction region like as the suction region 391 and a high pressure region like as the high pressure region 392 in the pump chambers 40, 41, 42, respectively. As shown in FIG. 3*a*, the rotors 27, 32 define a suction region 431 like as the suction region 391 , and a high pressure region 432 like as the high pressure region 392 in the pump chamber 43.

As shown in FIG. 1*a*, a gear case 33 is coupled to the rear housing 14. The rotary shafts 19, 20 extend through the gear case 33 and protrude their rear ends into the gear case 33. A pair of gears 34, 35 secured to the respective rear ends of the rotary shafts 19, 20 is engaged with each other. An electric motor M is installed to the gear case 33. Driving force of the electric motor M is transmitted to the rotary shaft 19 through a coupling 44, and the rotary shaft 19 is rotated by the electric motor M in a direction of an arrow R1 in FIGS. 2*a*, 2*b* and 3*a*. Rotation of the rotary shaft 19 is transmitted to the rotary shaft 20 through a pair of the gears 34, 35, and the rotary shaft 20 is rotated in a direction of an arrow R2 (a counter direction relative to the direction in which the rotary shaft 19 rotates) as shown in FIGS. 2*a*, 2*b* and 3*a*. Namely, the rotary shafts 19, 20 are synchronously rotated through the gears 34, 35.

As shown in FIG. 2*b*, passages 163 are formed within the partition walls 16, and inlets 164 and outlets 165 of the passage 163 are formed in the partition walls 16, respectively. The coadjacent pump chambers 39, 40, 41, 42, 43 are intercommunicated via the passages 163.

As shown in FIG. 2*a*, an intake port 181 is formed in the block piece 18 so as to communicate with the suction region 391 in the pump chamber 39. As shown in FIG. 3*a*, an exhaust port 171 is formed in the block piece 17 so as to communicate with the high pressure region 432 in the pump chamber 43. Gas introduced from the intake port 181 into the suction region 391 in the pump chamber 39 is transferred to the high pressure region 392 due to rotation of the rotors 23, 28. The gas transferred to the high pressure region 392 is compressed, so that pressure in the high pressure region 392 is higher than pressure in the suction region 391. The gas in the high pressure region 392 is transferred to the suction region in the coadjacent pump chamber 40 via the frontmost inlet 164 of the frontmost partition wall 16, the frontmost passage 163 and the frontmost outlet 165. Likewise, the gas is transferred in order of reducing volume, that is, in order of the pump chambers 40, 41, 42, 43. The gas transferred into the suction region 431 in the pump chamber 43 is transferred into the high pressure region 432 due to rotation of the rotors 27, 32, and is exhausted outside via the exhaust port 171. The rotors 23 through 32 are gas transferring assemblies.

The exhaust port 171 is an exhaust passage exhausting the gas outside the housing. The pump chamber 43 is a rearmost pump chamber communicating with the exhaust port 171, or the exhaust passage. Pressure in the high pressure region 432 in the rearmost pump chamber 43 is the highest among the pump chambers 39 through 43. The exhaust port 171 communicates with the highest high pressure region 432 defined by the rotors 27, 32 in the pump chamber 43.

Figure 4A:
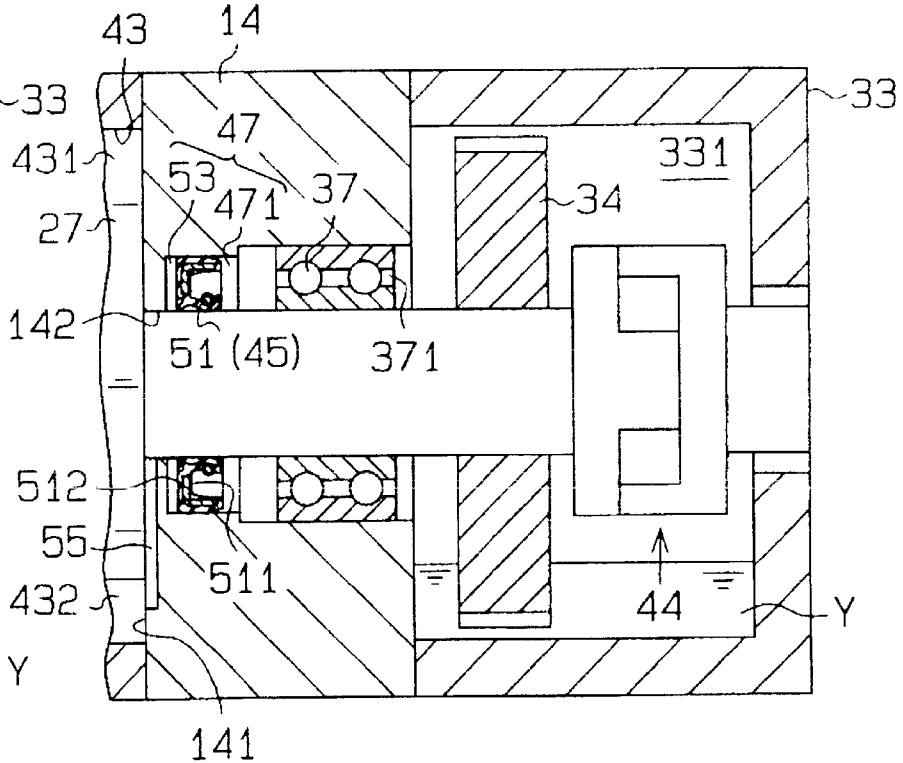
FIG. 4*a* is a cross-sectional view, taken along the line V—V in FIG. 3*b;*
Figure 4B:
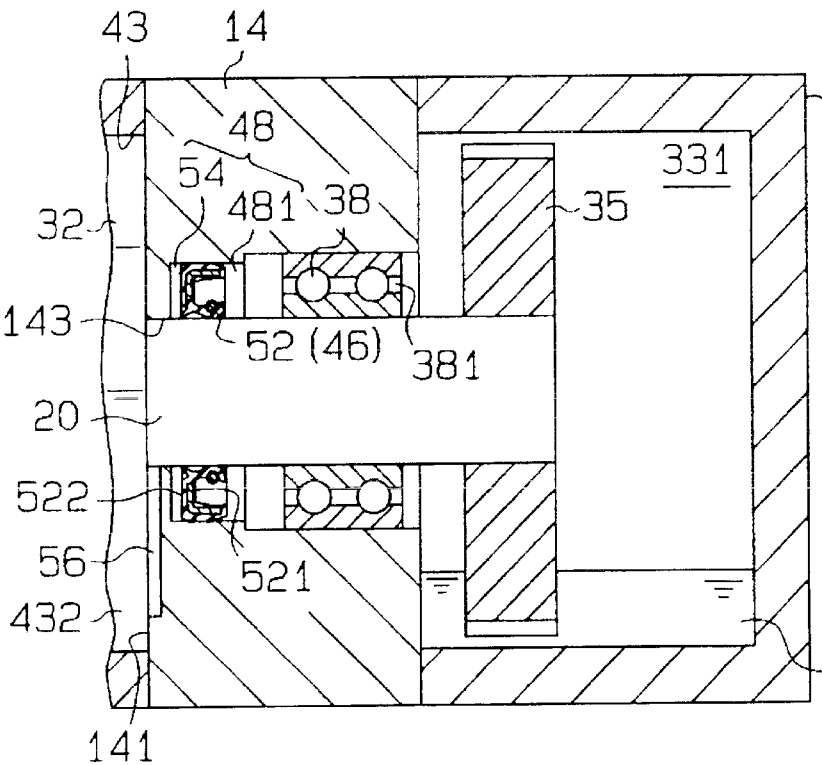
FIG. 4*b* is a cross-sectional view, taken along the line VI—VI in FIG. 3*b;*

As shown in FIG. 4*a*, a seal chamber 47 is defined around the rotary shaft 19 between the radial bearing 37 and the rotor 27. The lip seal 45 is accommodated in the seal chamber 47. As shown in FIG. 4*b*, a seal chamber 48 is defined around the rotary shaft 20 between the radial bearing 38 and the rotor 32. The lip seal 46 is accommodated in the seal chamber 48.

As shown in FIG. 1*c*, the lip seal 45 is constituted of a ring-shaped metal retainer 49 and a lip seal ring 51, which is made of elastic resin such as rubber, supported by the metal retainer 49 so as to cover a part of the metal retainer 49 with the lip seal ring 51. As shown in FIG. 1*b*, the lip seal 46 is constituted of a ring-shaped metal retainer 50 and a lip seal ring 52, which is made of elastic resin such as rubber, supported by the metal retainer 50 so as to cover a part of the metal retainer 50 with the lip seal ring 52. An inner circumferential surface of the lip seal ring 51 of the lip seal 45 accommodated in the seal chamber 47 contacts with an outer circumferential surface 192 of the rotary shaft 19. An inner circumferential surface of the lip seal ring 52 of the lip seal 46 accommodated in the seal chamber 48 contacts with an outer circumferential surface 202 of the rotary shaft 20.

The lip seal 45 divides the seal chamber 47 into a back pressure chamber 53 facing to the pump chamber 43 and an oil chamber 471 facing to the radial bearing 37. The lip seal 46 divides the seal chamber 48 into a back pressure chamber 54 facing to the pump chamber 43 and an oil chamber 481 facing to the radial bearing 38. The back pressure chambers 53, 54 are back pressure regions in the present embodiment. The back pressure chamber 53 is defined between the lip seal ring 51 and the pump chamber 43. The back pressure chamber 54 is defined between the lip seal ring 52 and the pump chamber 43. The oil chambers 471, 481 communicates with a gear chamber 331 via gaps 371, 381 between rings within the radial bearings 37, 38 and chambers 144, 145 of the radial bearings 37, 38, respectively (shown in FIG. 1*a*).

As shown in FIGS. 4*a*, 4*b*, lubricant Y is prepared in the gear chamber 331 in the gear case 33. The lubricant Y lubricates the gears 34, 35. The gears 34, 35 constituting the gear mechanism are accommodated in the gear chamber 331 in the gear case 33. The gear chamber 331 is a region in which oil exists, and the region is sealed so as not to communicate with the outside of the housing of the multi-stage roots pump 11. The chambers 144, 145 of the radial bearings 37, 38 communicating with the gear chamber 331 are also the region in which the oil exists. The lubricant Y prepared in the gear chamber 331 is swashed due to rotation of the gears 34, 35, and lubricates the radial bearings 37, 38. The lubricant Y also passes through the gaps 371, 381 between the rings within the radial bearings 37, 38, and flows into the oil chambers 471, 481. The lubricant Y lubricates the lip seal rings 51, 52 of the lip seals 45, 46. The lip seal rings 51, 52 of the lip seals 45, 46 prevent the lubricant Y from leaking from the oil chambers 471, 481 along the outer circumferential surfaces 192, 202 of the rotary shafts 19, 20 into the back pressure chambers 53, 54.

Figure 3B:
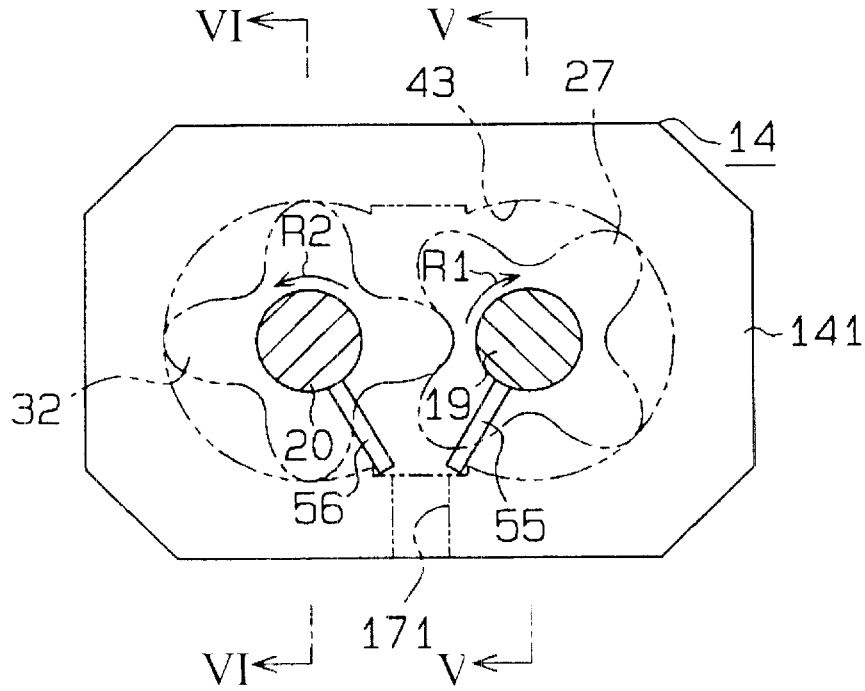
FIG. 3*b* is a cross-sectional end view, taken along the line IV—IV in FIG. 1.

As shown in FIG. 3*b*, a wall surface 141 of the rear housing 14 defines the pump chamber 43, and recesses 55, 56 for applying pressure in an exhaust passage are formed on the wall surface 141. The recess 55 communicates with the highest compression chamber 432 which varies its volume in accordance with the rotation of the rotors 27, 32. The recess 55 also communicates with a shaft hole 142 for extending the rotary shaft 19 through the rear housing 14 (shown in FIG. 4*a*). The recess 56 communicates with the highest compression chamber 432, and communicates with a shaft hole 143 for extending the rotary shaft 20 through the rear housing 14 (shown in FIG. 4*b*). The gear chamber 331, or the region in which the oil exists, and the rearmost pump chamber 43 communicating with the exhaust port 171 are divided by the rear housing 14 as a dividing wall, and the rotary shafts 19, 20 extend through the rear housing 14 so as to protrude their rear ends into the gear chamber 331.

The following advantageous effect can be obtained in the first embodiment.

(1-1) A small gap is provided between the outer circumferential surface 192 of the rotary shaft 19 and the shaft hole 142, and another small gap is provided between the rotors 27, 32 and the wall as surface 141 of the rear housing 14. Therefore, pressure in the rearmost pump chamber 43 is applied to the back pressure chamber 53 via the small gaps. Likewise, a small gap is also provided between the outer circumferential surface 202 of the rotary shaft 20 and the shaft hole 143. Therefore, pressure in the rearmost pump chamber 43 is also applied to the back pressure chamber 54.

When the recesses 55, 56 are not provided for the rear housing 14, pressure in the suction region 431 applied to the back pressure chamber 53, 54 is substantially the same as the pressure in the highest high pressure region 432 applied to the back pressure region 53, 54. The pressure applied to the back pressure surfaces 53, 54 of the lip seal rings 51, 52 is intermediate pressure relative to the pressure in the suction region 431 and the pressure in the highest high pressure region 432, and is expressed as follows.

$$P_b=(P2+P1)/2$$

$P_b$ denotes the pressure applied to the back pressure surfaces 512, 522 of the lip seal rings 51, 52. P1 denotes the pressure in the suction region 431 in the rearmost pump chamber 43. P2 (>P1) denotes the pressure in the highest high pressure region 432. On the other hand, pressures in the oil chambers 471, is 481 communicating with the gear chamber 331 do not up vary because motion of the rotors 23 through 32 does not act in the oil chambers 471, 481. Therefore, in those are substantially the same as atmospheric pressure (about 1000 Torr). Substantially the same as atmospheric pressure is applied to pressure surfaces 511, 521 of the lip seal rings 51, 52. Accordingly, pressure differences between the two surfaces of the lip seal rings 51, 52 are $P_{diff.}$ (Torr) expressed as follows.

$$P_{diff.}=1000-(P2+P1)/2$$

$P_{diff.}$ denotes the pressure difference.

The recesses 55, 56 in the present embodiment help the pressure in the highest high pressure region 432 to be applied to the back pressure chamber 53, 54. That is, the pressure in the highest pressure region 432 applied to the back pressure chambers 53, 54 via the recesses 55, 56 is much higher than the pressure in the suction region 431 applied to the back pressure chambers 53, 54. Accordingly, the pressures in the back pressure chambers 53, 54 are much higher than the above-mentioned $P_b$ (Torr), and the pressure difference between the two surfaces of the lip seal rings 51, 52 is much lower than the above-mentioned $P_{diff.}$. Consequently, such structure having the recesses 55, 56 further prevents the lubricant Y from leaking from the oil chambers 471, 481 into the back pressure chambers 53, 54, and sealing performance of the lip seal rings 51, 52 improves. Besides, durability of the lip seal rings 51, 52 also improves, and lifetime of the lip seal rings 51, 52 may be lengthened.

(1-2) As the cross sections of the recesses 55, 56 expand, the pressure in the highest high pressure region 432 applied to the back pressure chambers 53, 54 via the recesses 55, 56 also increases. The recesses 55, 56 having desired cross sections can easily be formed, and are appropriate for applying the pressure in the highest high pressure region 432 to the back pressure chambers 53, 54.

(1-3) The recesses 55, 56 are formed on the wall surface 141 of the rear housing 14 constituting a part of a circumferential wall defining the pump chamber 43. The shaft holes 142, 143 for extending the rotary shafts 19, 20 through the rear housing 14 are bored through the wall surface 141, and the highest high pressure region 432 constituting a part of the pump chamber 43 is in the vicinity of the wall surface 141. Accordingly, forming passages on the wall surface 141 for applying the pressure in the exhaust passage so as to intercommunicate the shaft holes 142, 143 and the highest high pressure region 432 is easy. Namely, the wall surface 141 is appropriate for forming the passages for applying the pressure in the exhaust passage so as to intercommunicate the shaft holes 142, 143 and the highest high pressure region 432.

(1-4) The lubricant Y is not used in the pump chambers 39 through 43 in the dry pump such as the roots pump 11. The roots pump 11 that may not use the lubricant Y in the pump chambers 39 through 43 is appropriate for applying the present invention.

Figure 5A:
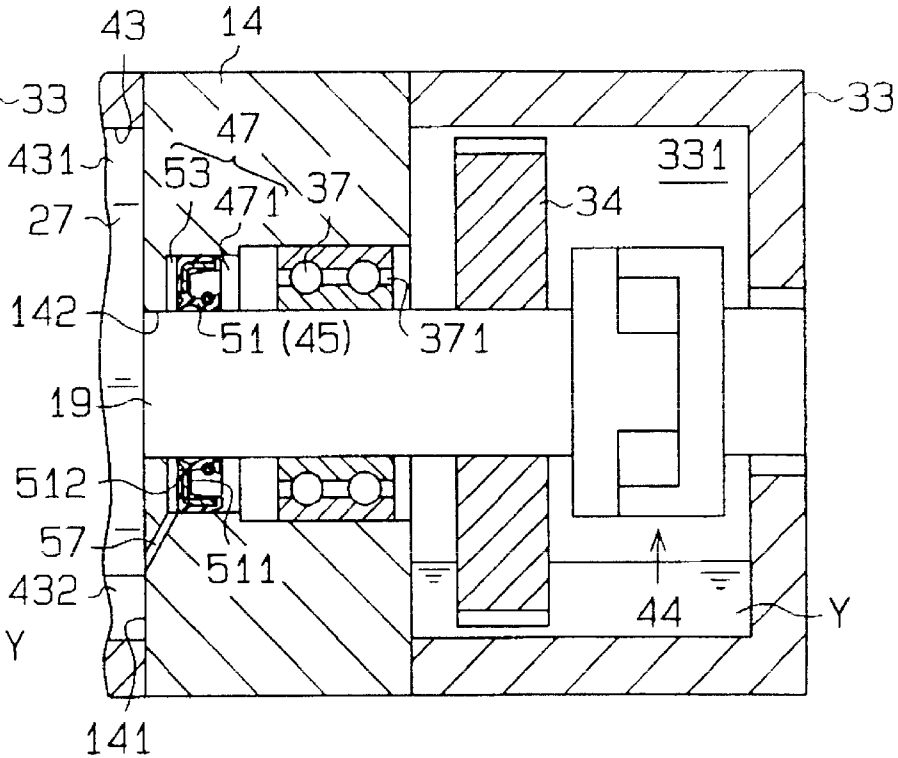
FIG. 5*a* is a longitudinal sectional view illustrating a rotary shaft 19 side according to a second embodiment of the present invention.
Figure 5B:
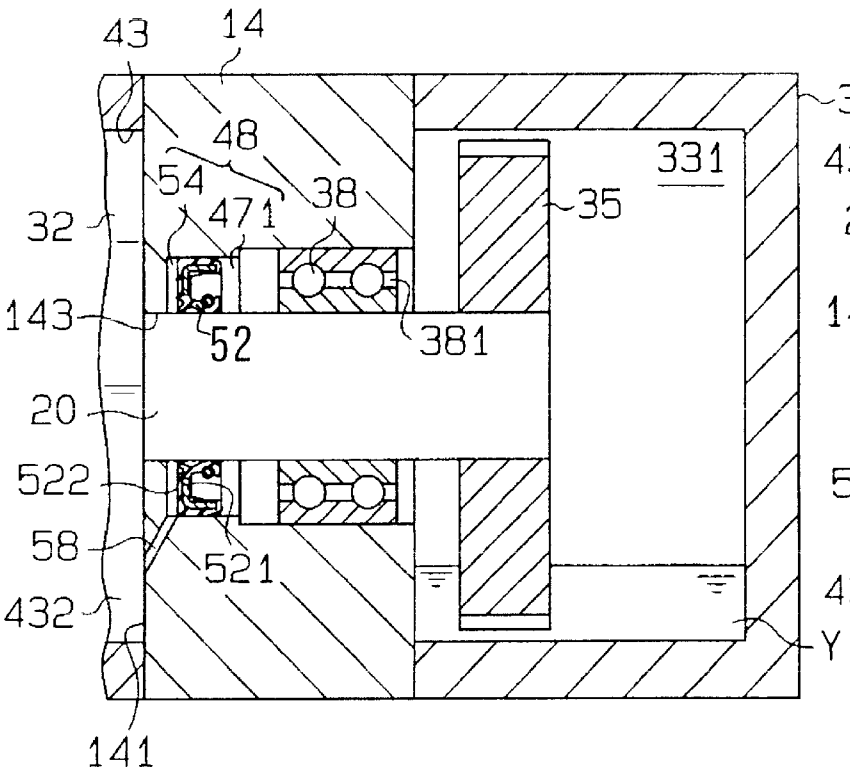
FIG. 5*b* is a longitudinal sectional view illustrating a rotary shaft 20 side according to the second embodiment of the present invention.

A second embodiment of the present invention will now be described with reference to FIGS. 5*a*, 5*b*. The same reference numerals denote the same components in the first embodiment.

Passages 57, 58 for applying the pressure in the exhaust passage communicating with the highest high pressure region 432 are directly connected with the back pressure chambers 53, 54 bored through the rear housing 14. The same advantageous effects as the paragraphs (1-1) and (1-4) in the first embodiment can be obtained in the second embodiment.

Figure 6A:
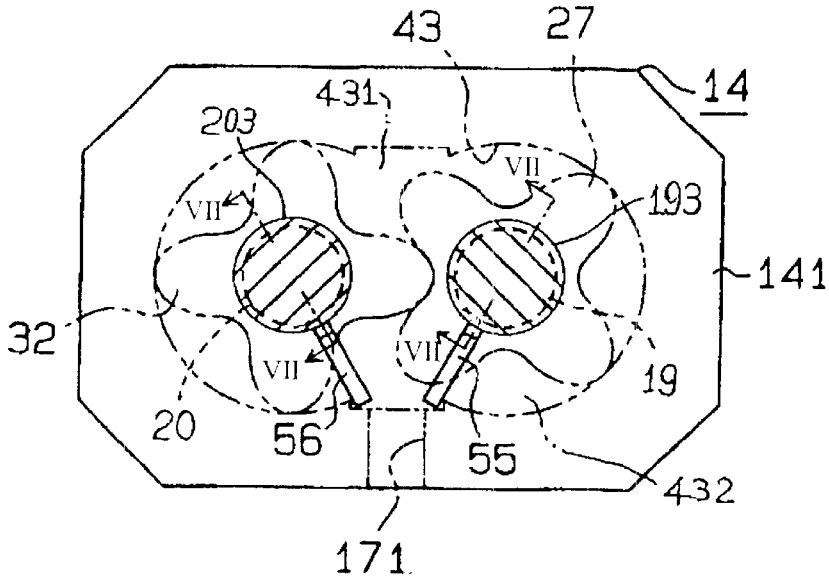
FIG. 6*a* is a cross-sectional end view according to a third embodiment of the present invention.
Figure 6B:
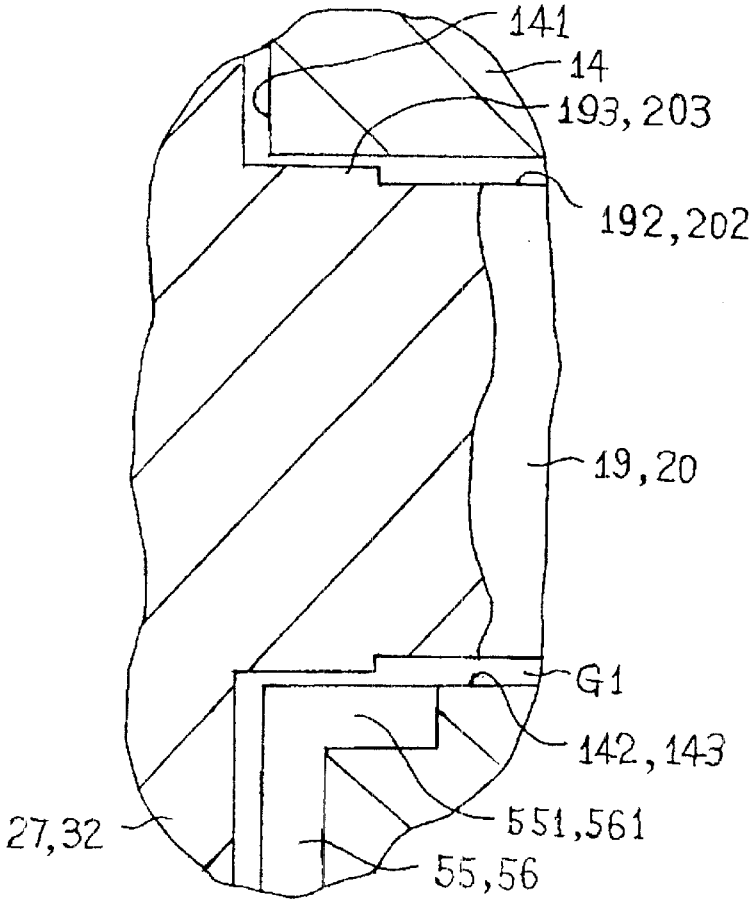
FIG. 6*b* is an enlarged partial cross-sectional view, taken along the line VII—VII in FIG. 6*a;*

A third embodiment of the present invention will now be described with reference to FIGS. 6*a*, 6*b*. The same reference numerals denote the same components in the first embodiment.

Gaps G1 are provided between the outer circumferential surfaces 192, 202 of the rotary shafts 19, 20 and the shaft holes 142, 143, respectively. Annular extending portions 193, 203 as first extending portions in the present invention are formed on the circumferential surfaces 192, 202 of the rotary shafts 19, 20 in the vicinity of the rotors 27, 32, respectively. Ends 551, 561 of the recesses 55, 56 for applying the pressure in the exhaust passage are hooked or crank-shaped so as to connect with the gaps G1. In other words, the recesses 55, 56 pass by a part of the extending portions 193, 203, and reach the shaft holes 142, 143. The cross sections of the recesses 55, 56 connecting with the gaps G1 are same as the cross sections of the recesses 55, 56 in the first embodiment.

The drive shafts 19, 20 are provided with the extending portions 193, 203, so that the gaps to between the outer circumferential surfaces 192, 202 of the rotary shafts 19, 20 and the shaft holes 142, 143 become narrow. Thereby, the cross sections of passages between the suction region 431 and the gaps G1 become much smaller than those between the highest high pressure region 432 and the gaps G1. Therefore, the pressure in the suction region 431 applied to the back pressure chambers 53, 54 is smaller than that of the first embodiment, and the pressure in the highest compression chamber 432 applied to the back pressure chambers 53, 54 is relatively larger. Consequently, such structure having the extending portions 193, 203 further prevents the lubricant Y from leaking from the oil chambers 471, 481 into the back pressure chambers 53, 54, and the sealing performance of the lip seal rings 51, 52 further improves, as compared with that of the first embodiment. Besides, the durability of the lip seal rings 51, 52 further improves, and the lifetime of the lip seal rings 51, 52 may be lengthened.

Figure 7A:
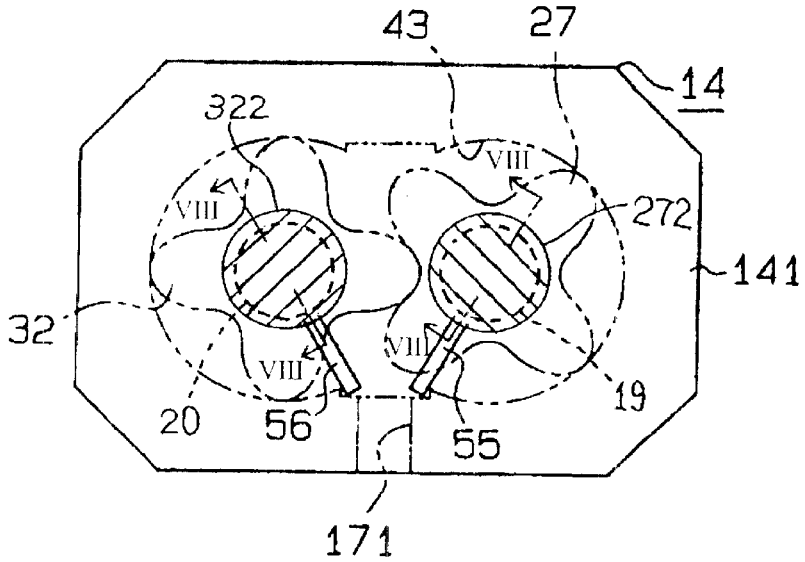
FIG. 7*a* is a cross-sectional end view according to a fourth embodiment of the present invention.
Figure 7B:
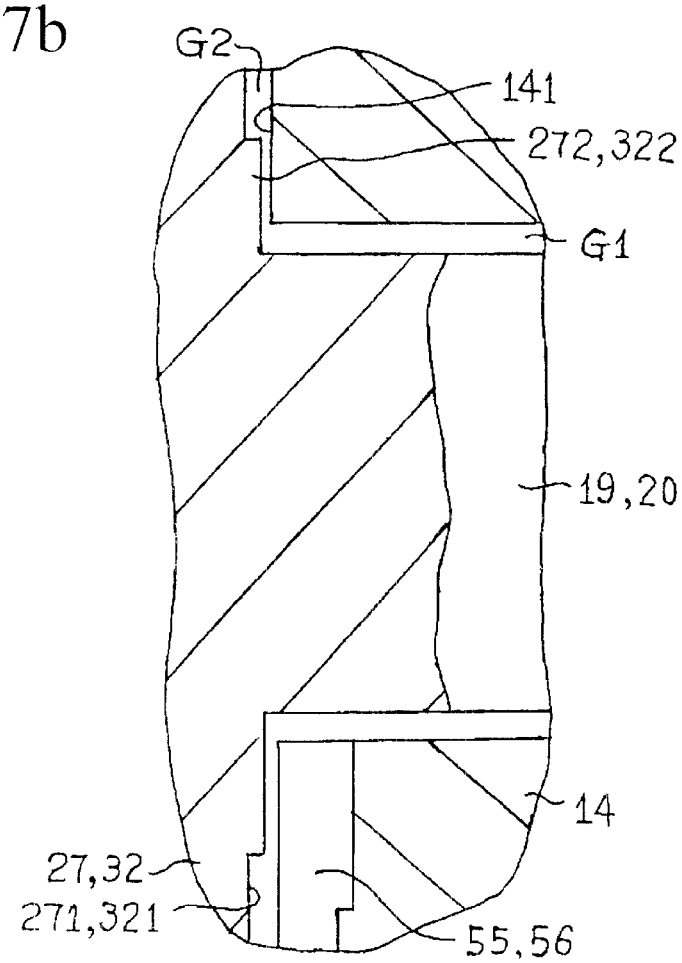
FIG. 7*b* is an enlarged partial cross-sectional view, taken along the line VIII—VIII in FIG. 7*a;*

A fourth embodiment of the present invention will now be described with reference to FIGS. 7*a*, 7*b*. The same reference numerals denote the same components in the third embodiment.

Gaps G2 are provided between rear ends 271, 321 of the rotors 27, 32 and the wall surface 141 of the rear housing 14. Annular extending portions 272, 322 as second extending portions are formed on the rear end surfaces 271, 321 of the rotors 27, 32. The extending portions 272, 322 function as well as the extending portions 193, 203 in the third embodiment.

The present invention is not limited to the embodiments described above, but may be modified into examples as follows.

(1) The exhaust port 171 and the back pressure chambers 53, 54 are directly intercommunicated via passages for applying the pressure in the exhaust passage.

Figure 8A:
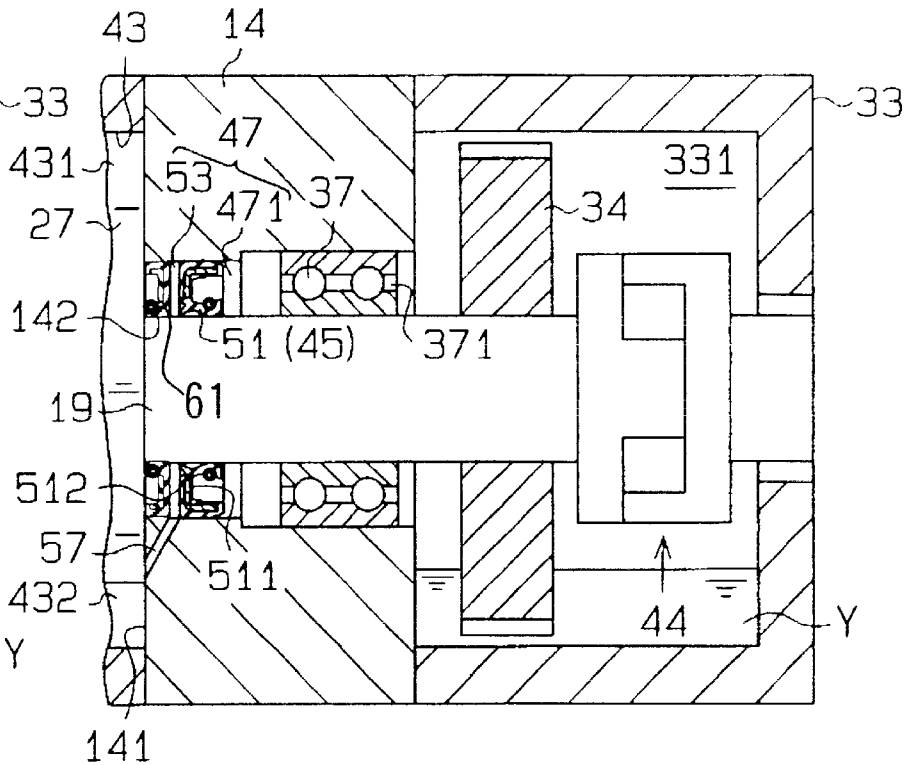
FIG. 8*a* is a longitudinal sectional view illustrating a rotary shaft 19 side according to an alternative embodiment of the present invention.
Figure 8B:
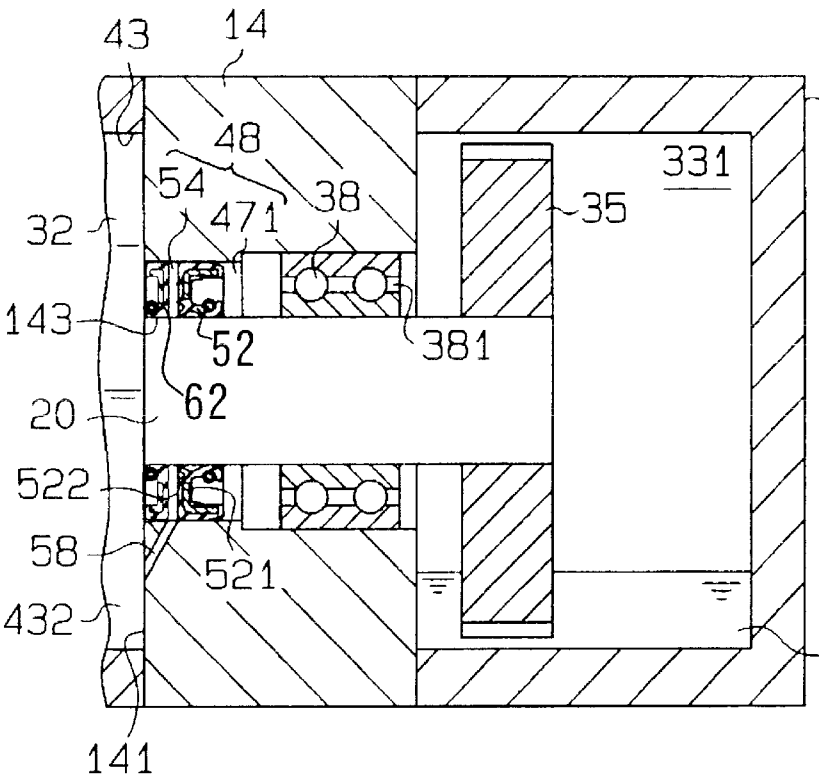
FIG. 8*b* is a longitudinal sectional view illustrating a rotary shaft 20 side according to the alternative embodiment of the present invention.

(2) As shown in FIGS. 8*a*, 8*b*, a pair of lip seal rings 51, 61 is disposed in series between the rearmost pump chamber 43 and the gear chamber 331. Likewise, a pair of lip seal rings 52, 62 is disposed in series between the rearmost pump chamber 43 and the gear chamber 331. A back pressure chamber 53 is defined between the lip seal rings 51, 61. Another back pressure chamber 54 is defined between the lip seal rings 52, 62. The highest pressure region 432 in the rearmost pump chamber 43 and the back pressure chambers 53, 54 are intercommunicated via the passages for applying the pressure in the exhaust passage same as those of the second embodiment.

(3) The present invention may be applied to a roots pump that is provided with a single pump chamber.

(4) The present invention may be applied to a is vacuum pump other than a roots pump.

According to the present invention described above, the housing of the vacuum pump is provided with the passage communicating with the exhaust passage. The pressure in the exhaust passage or substantially the same pressure as the pressure in the exhaust passage is applied to the back pressure surface of the lip seal ring via the passage. Therefore, the vacuum pump ensures the sealing performance, and the lifetime of the lip seal may be lengthened.

Therefore the present examples and embodiments are to be considered as illustrative and not restrictive and the invention is not to be limited to the details given herein but may be modified within the scope of the appended claims.

What is claimed is:

1. A shaft seal structure for a vacuum pump, comprising:

a housing accommodating a rotary shaft and a gas transferring assembly driven by the rotary shaft, the housing having an exhaust passage for exhausting gas outside the housing, the gas transferring assembly creating a vacuum;

a lip seal for shaft seal disposed between a pump, chamber communicating with said exhaust passage and a region in which oil exists so as to slide relative to a circumferential surface of the rotary shaft, and having a back pressure surface in a back pressure region facing the pump chamber, and a pressure surface facing the region in which the oil exists; and a communicating passage in the housing intercommunicating the back pressure region and said exhaust passage for applying at least substantially the pressure in said exhaust passage to the back pressure surface.

2. A shaft seal structure for a vacuum pump according to claim 1, wherein:

at least substantially the pressure in said exhaust passage is pressure in a highest pressure region in the pump chamber communicating with said exhaust passage; and said communicating passage applies the pressure in the highest pressure region to the back pressure surface of said lip seal.

3. A shaft seal structure for a vacuum pump according to claim 1, wherein:

the housing forming said communicating passage includes a dividing wall;

said region in which the oil exists and the pump chamber communicating with said exhaust passage are divided by the dividing wall; and the rotary shaft extends through a bore in the dividing wall from the pump chamber communicating with said exhaust passage to said region in which the oil exists.

4. A shaft seal structure for a vacuum pump according to claim 3, wherein:

the dividing wall provides a wall surface defining said pump chamber;

said communicating passage is a recessed channel in the wall surface; and said channel extends to the dividing wall bore.

5. A shaft seal structure for a vacuum pump according to claim 4 further comprising:

a first extending portion formed on the circumferential surface of the rotary shaft so as to reduce a gap between the circumferential surface of the rotary shaft and the shaft hole; and wherein said recess reaches the shaft hole so as to pass by a part of said first extending portion.

6. A shaft seal structure for a vacuum pump according to claim 4 further comprising:

a second extending portion formed on the rear end surface of the rotor so as to reduce a gap between the rear end surface of the rotor and the dividing wall; and wherein said recess reaches the shaft hole so as to pass by a part of said second extending portion.

7. A shaft seal structure for a vacuum pump according to claim 1, wherein said region in which the oil exists is a region accommodating a bearing for rotatably supporting the rotary shaft.

8. A shaft seal structure for a vacuum pump according to claim 1, wherein the vacuum pump is a roots pump, wherein the gas transferring mechanism comprises:

a plurality of generally parallel rotary shafts, each carrying a rotor, with adjacent rotors being engaged with each other; and a set of the engaged rotors is accommodated in either a plurality of pump chambers or a single pump chamber.

9. A shaft seal structure for a vacuum pump according to claim 8, wherein:

a plurality of the rotary shafts is synchronously driven through a gear mechanism; and said region in which the oil exists includes a region accommodating the gear mechanism.

10. A shaft seal structure for a vacuum pump according to claim 1, wherein:

a pair of said lip seals disposed between the pump chamber and the region in which the oil exists so as to slide relative to the circumferential surface of the rotary shaft; and said communicating passage for applying at least substantially the pressure in said exhaust passage to the back pressure surface opposed to the pressure surface of said lip seal disposed in the vicinity of the region in which the oil exists.

* * * * *

UNITED STATES PATENT AND TRADEMARK OFFICE

CERTIFICATE OF CORRECTION

PATENT NO. : 6,554,594 B2
DATED : April 29, 2003
INVENTOR(S) : Shinya Yamamoto et al.

It is certified that error appears in the above-identified patent and that said Letters Patent is hereby corrected as shown below:

Column 6,
Line 60, please delete “wall as surface” and insert therefore -- wall surface --;

Column 7,
Line 18, please delete “471, is 481” and insert therefore -- 471, 481 --;
Line 20, please delete “Therefore, in those” and insert therefore -- Therefore, those --;

Column 9,
Line 18, please delete “applied to a is vaccum” and insert therefore -- applied to a vaccum --;
Line 40, please delete “pump, chamber” and insert therefore -- pump chamber --.

Signed and Sealed this

Ninth Day of September, 2003

JAMES E. ROGAN
*Director of the United States Patent and Trademark Office*